United States Patent [19]

Butler et al.

[11] 4,119,248

[45] Oct. 10, 1978

[54] PORTABLE ARTICLE CARRIER

[76] Inventors: J. Clinton Butler, P.O. Box 488; Sidney W. Kubala, P.O. Box 943, both of Van, Tex.

[21] Appl. No.: 777,263

[22] Filed: Mar. 14, 1977

[51] Int. Cl.[2] ..... A45C 11/00

[52] U.S. Cl. ..... 224/5 W; 16/150; 206/203; 220/339; 220/375; 224/5 R; 224/26 R

[58] Field of Search ..... 224/5 R, 5 V, 5 W, 5 BC, 224/5 G, 7 B, 26 R, 28 B; 220/9 F, 85 H, 334, 339, 375; 16/150; 206/139, 203; D7/77

[56] References Cited

U.S. PATENT DOCUMENTS

| | | | |
|---|---|---|---|
| D. 218,908 | 10/1970 | Bright et al. | D7/77 |
| 1,208,728 | 12/1916 | Bartlett et al. | 224/5 R |
| 1,514,130 | 11/1924 | Clements | 220/334 X |
| 2,524,639 | 10/1950 | Saunders | 224/26 R |
| 3,103,278 | 9/1963 | Kuzma et al. | 220/9 F X |
| 3,225,983 | 12/1965 | Majka | 224/7 B X |
| 3,416,852 | 12/1968 | Goldbeck et al. | 220/339 X |
| 3,734,336 | 5/1973 | Rankow et al. | 220/9 F X |
| 3,843,032 | 10/1974 | Moran et al. | 224/5 W |
| 3,910,470 | 10/1975 | Swenson et al. | 224/5 V |
| 4,018,371 | 4/1977 | George | 224/5 W X |

FOREIGN PATENT DOCUMENTS

| | | | |
|---|---|---|---|
| 357,840 | 12/1961 | Switzerland | 220/334 |

*Primary Examiner*—Trygve M. Blix
*Assistant Examiner*—Winston H. Douglas
*Attorney, Agent, or Firm*—Lawrence I. Field

[57] ABSTRACT

A portable carrier for one or more beverage cans or bottles, the carrier being made of a lightweight insulating material such as a foamed synthetic resin which retains the cold (or heat) of the contents of the container. The resin is molded with pocket(s) to receive the beverage containers and is provided with attachment means to which a strap can be attached so that the article carrier can be worn either on a belt carried by a shoulder strap in order to permit the user to withdraw a can or bottle by the use of only one hand. A preferred attachment means includes a harness which is shaped to receive the article carrier and to articulate with a cover on the carrier.

6 Claims, 13 Drawing Figures

PORTABLE ARTICLE CARRIER

This invention relates to a portable container for beverages or other canned goods. More specifically, the invention relates to a container adapted to be worn by a person and including means associated with the container for its support including support means and an adjustable shoulder strap and/or belt which cooperates with the support means so as to provide for carrying the container over the shoulder, or on the waist or upon the back, or elsewhere on the person. In one preferred embodiment, an adjustable shoulder or waist strap is attached to a harness by means of a fastener, which also serves as a swivel for the strap, thus providing for easy movement of the container from one position to another, e.g. from front to back, with the use of only one hand thereby allowing the user to change the position of the container on his person to suit his individual need or desire with minimal effort, whether the person is walking of standing still.

The container is preferably formed of a lightweight thermally insulating material such as a foamed synthetic resin and is provided with a plurality of pockets each dimensioned to hold a small quantity of beverage, for example a can or bottle. These cans and/or bottles are held in individual holes which are designed to insure that the bottles or cans cannot rattle or break by bumping together. The pockets may be in varied hole arrangements so as to eliminate bulkiness and permit any convenient number of cans or bottles to be carried.

One object of the invention is to provide a portable carrier for cans or bottles which is light in weight, and which is constructed of material which provides thermal insulation around the individual beverage containers.

Another object of the invention is to provide a portable carrier for cans or other small receptacles which is readily moved from one position to another on the person carrying the container.

Still another object of the invention is to provide a portable container from which the contents may be readily dispensed.

A further object of the invention is to provide an article carrier which can be supported by a strap serving either as a belt or as a shoulder strap at the option of the wearer.

These and other objects of the invention will become apparent or will be pointed out in the description which follows, taken in conjunction with the drawings in which.

Figure 1:
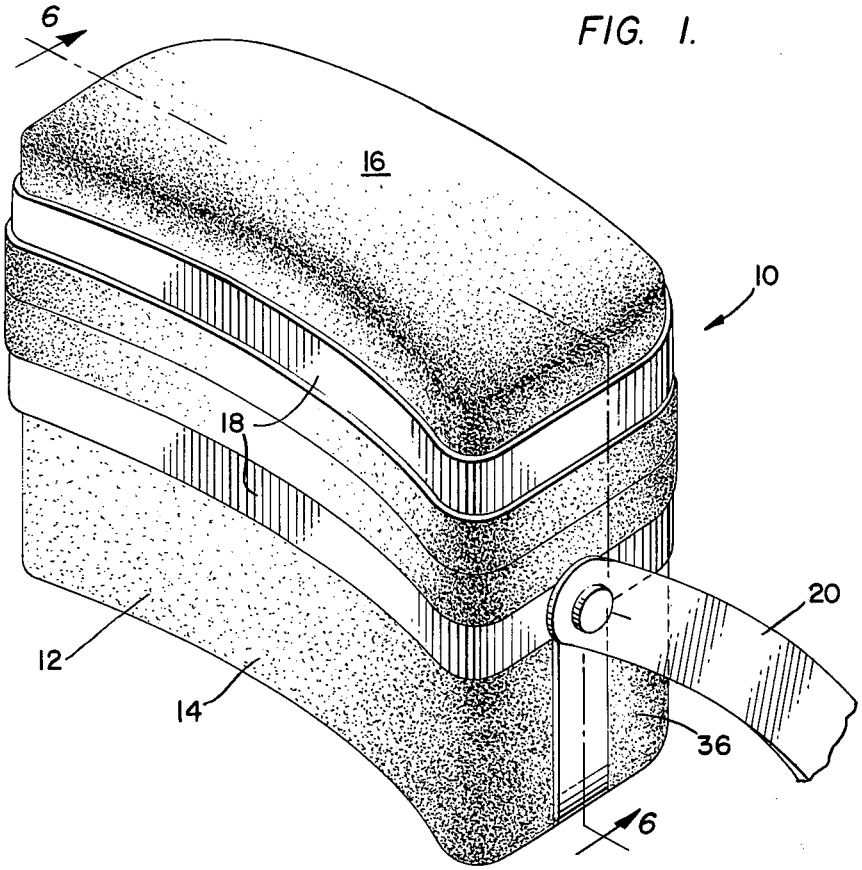
FIG. 1 is a perspective view of the article carrier of this invention with the cover closed.
Figure 2:
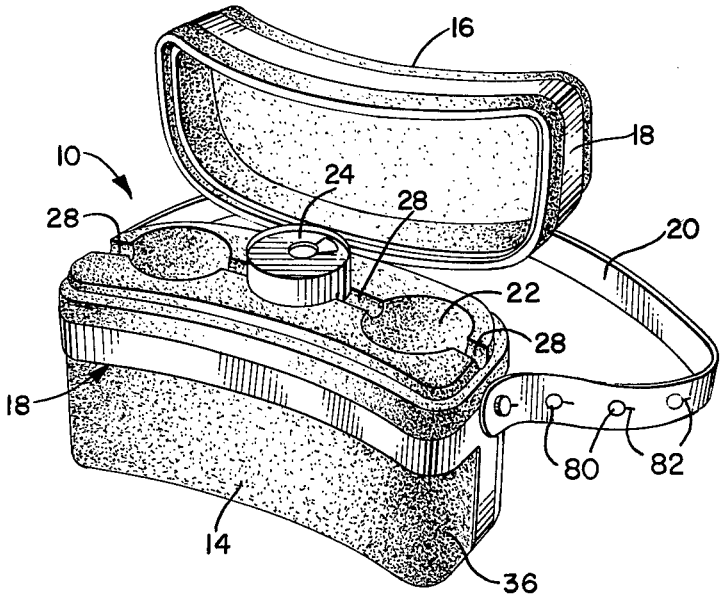
FIG. 2 is another perspective view of the article carrier showing the cover open.
Figure 3:
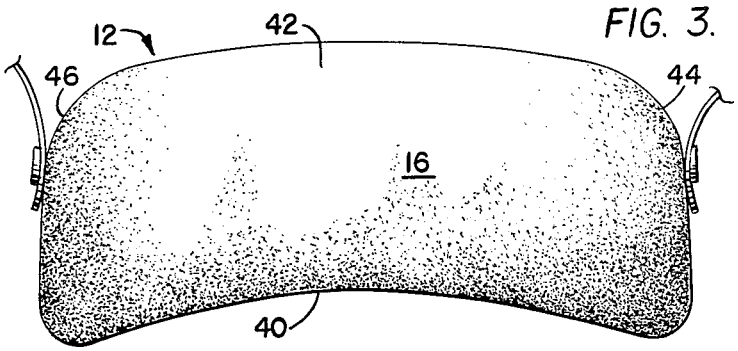
FIG. 3 is a top plan view of the article carrier.
Figure 4:
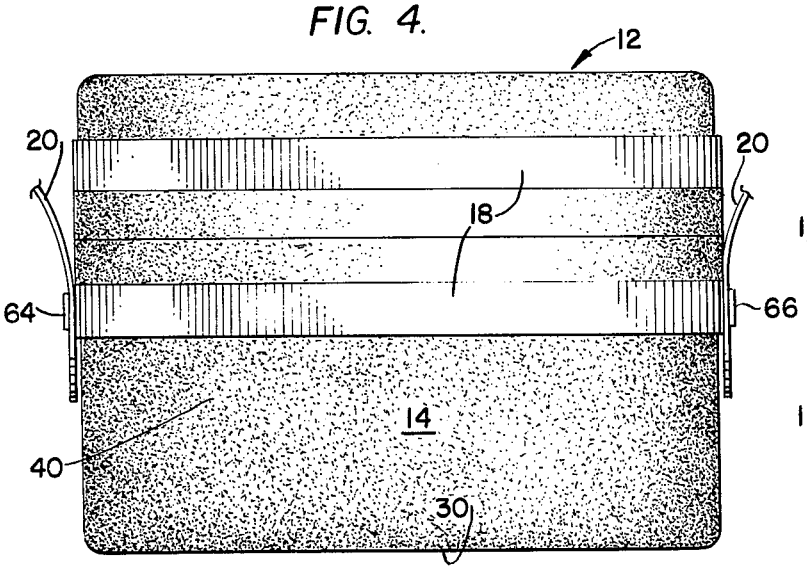
FIG. 4 is a front elevation of the article carrier.
Figure 5:
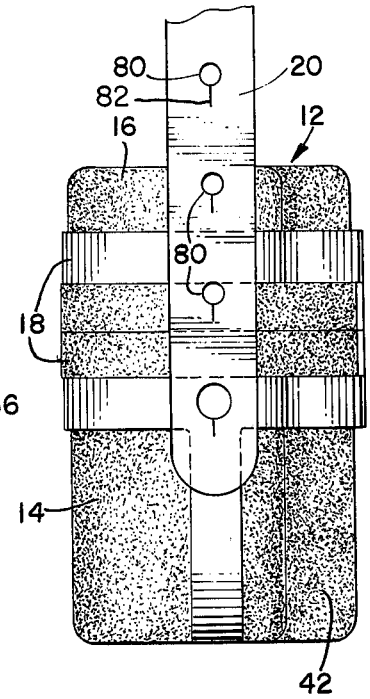
FIG. 5 is a side elevation of the article carrier.

As best seen in FIGS. 1 and 2 a preferred carrier 10 of this invention consists of receptacle 12 consisting of a body 14 and a cover 16; a harness 18 which cooperates with both the body 14 and cover 16; and a carrying strap 20.

Figure 6:
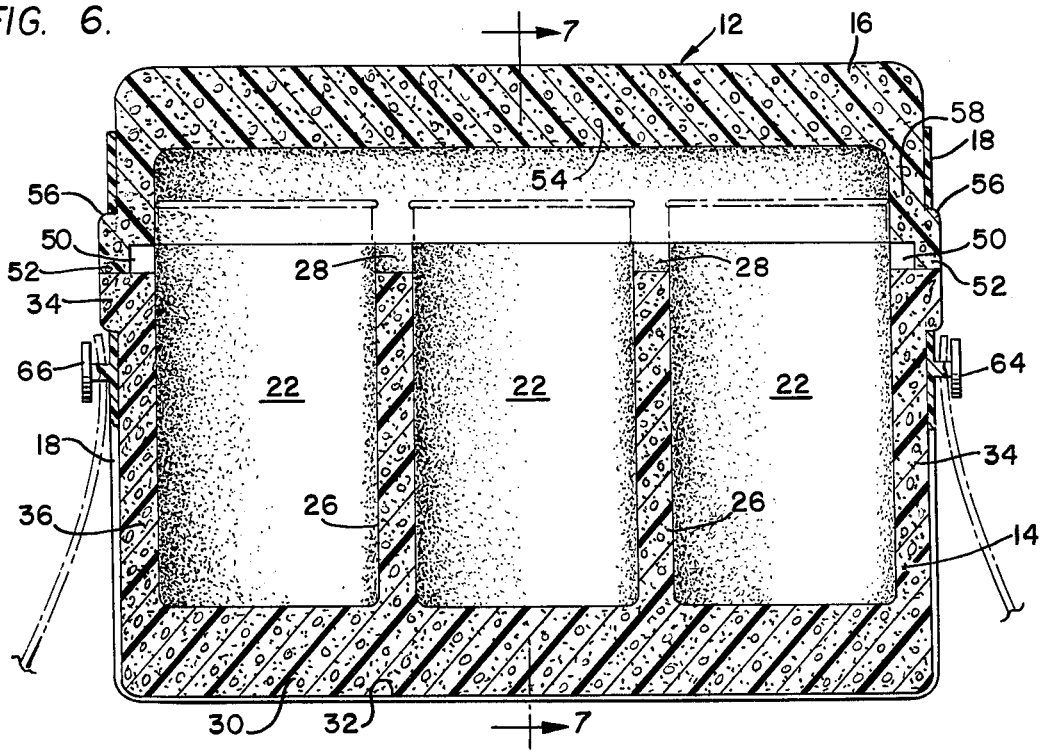
FIG. 6 is a section taken on line 6—6 of FIG. 1.
Figure 7:
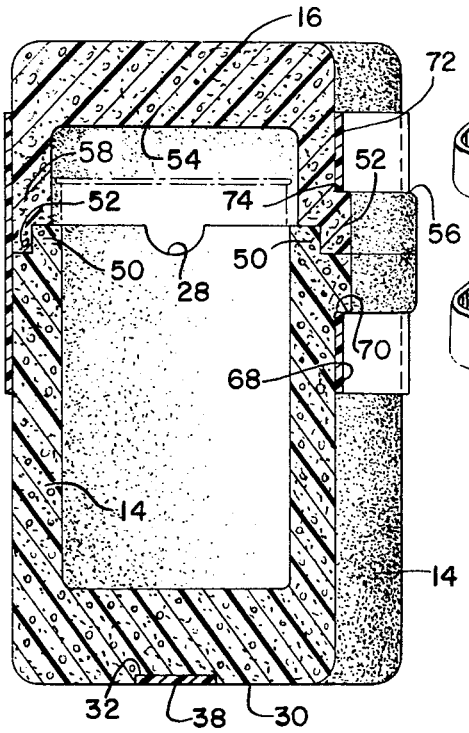
FIG. 7 is a section taken on line 7—7 of FIG. 6.
Figure 9:
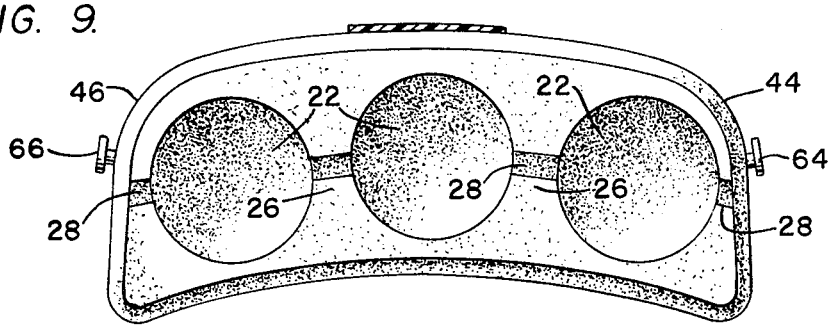
FIGS. 9, 10 and 11 are plan views showing pocket arrangements in the body of the carrier; and in FIGS. 12 and 13 are schematic views showing the article carrier being supported by the strap as a belt (FIG. 12) and as a shoulder strap (FIG. 13).
Figure 10:
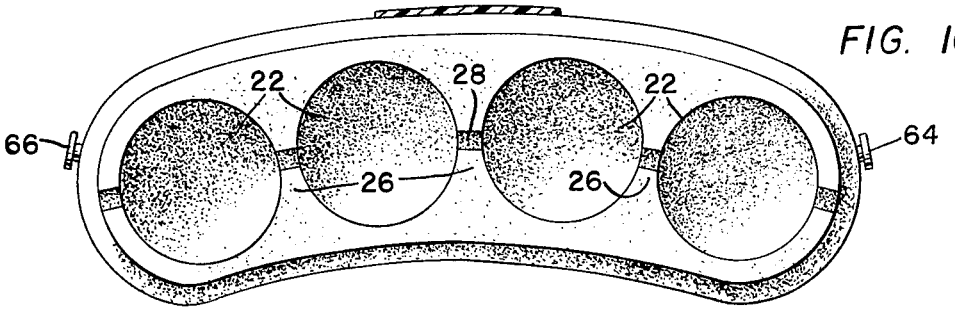
Figure 11:
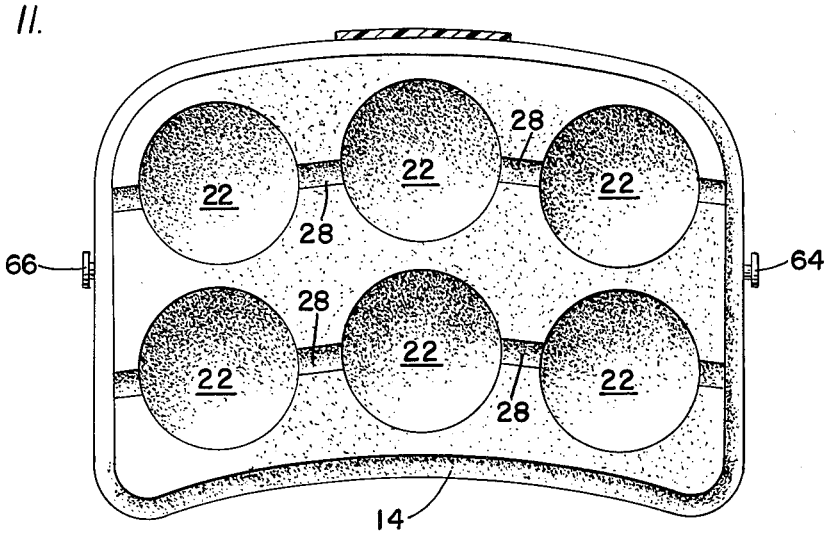
Figure 12:
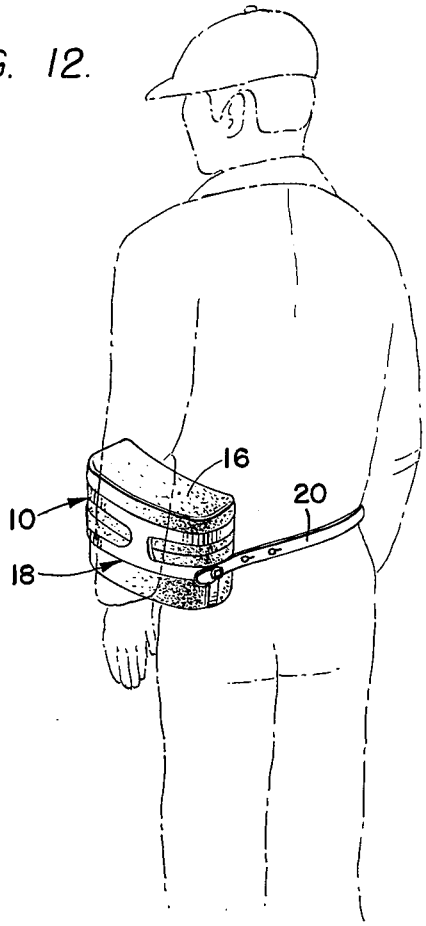
Figure 13:
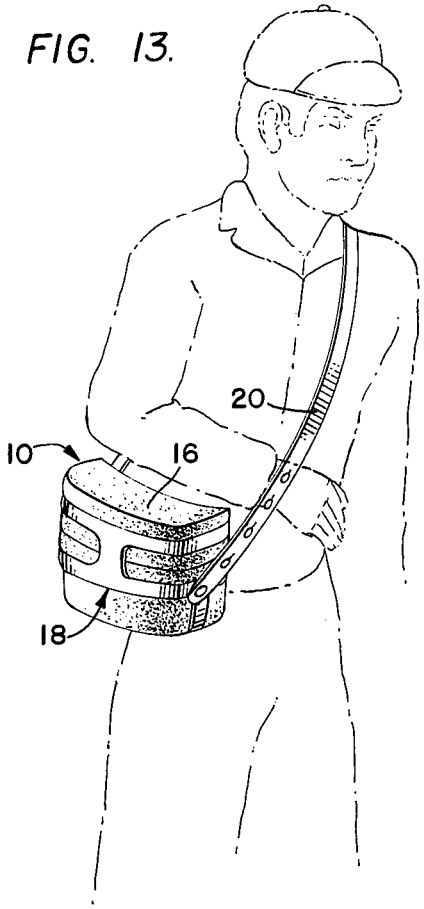

The body 14, consists of a light-weight rigid material such as foamed polyurethane or polystyrene or other similar material, molded with one or more pockets 22 (FIGS. 6 and 7) each dimensioned to receive a beverage can 24 or bottle. The pockets may be arranged in one or more rows, or in staggered relationship as shown in FIGS. 9, 10 and 11, the walls 26 between the pockets being of a sufficient thickness to retain the heat (or cold) in the contents of the receptacle 24 deposited in the pocket 22. Recesses 28 are provided to receive the fingers of a person withdrawing a beverage can 24 from a pocket 22.

Body 14 is generally in the shape of a parallelepiped, with a flat bottom wall 30. Bottom wall 30 is provided with a groove 32 which extends transversely from one end wall 34 to the opposite wall 36, and which is provided to receive the lowermost strap 38 of harness 18.

The inner sidewall 40 of the body is provided with a curvature as shown so as to make carrying of the container more comfortable to the wearer, the curvature conforming to the body of the user. The curvature of the ends 44 and 46 opposite outer side wall 42 helps to eliminate shifting of the article carrier when the user is walking in brushy or wooded areas.

The top surface of the body 14 is stepped at 50 around its periphery to receive a mating shaped depending rim 52 on the cover 16 in order to provide a friction fit seal when the cover 16 is seated on the body 14.

The cover 16 includes a top wall 54 and depending side walls 58. The side walls extend from rim 52 upwardly and are provided with a shoulder 56 to receive one of the straps of harness 18.

The underside of the cover is hollowed out to receive the tops of the cans held in pockets 22.

The body 14 and cover 16 are both preferably molded of rigid light weight thermally insulating material. Either or both may be painted or provided with a decorative finish on their exterior.

Figure 8:
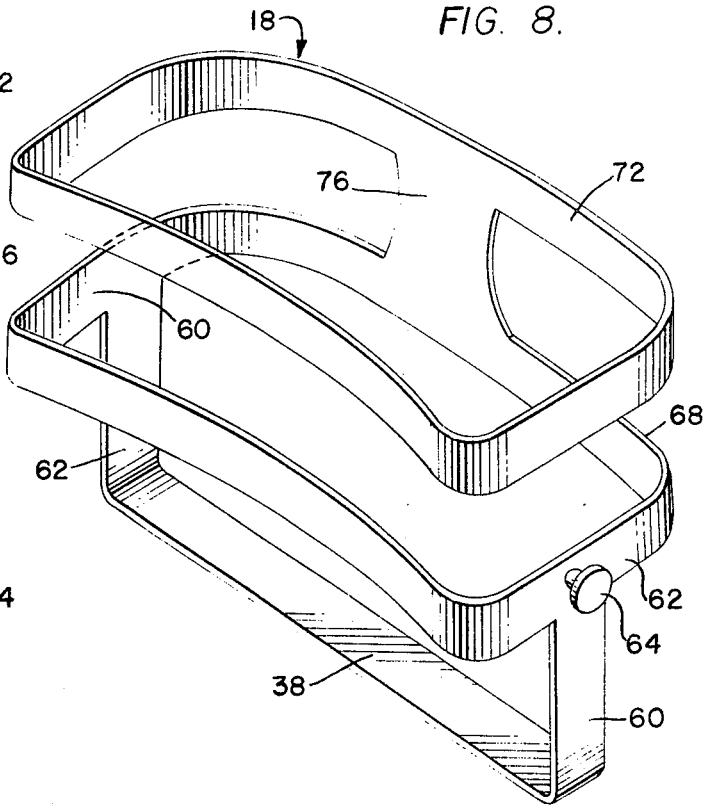
FIG. 8 is a view in perspective of the harness component of the article carrier.

The container 12 comprising body 14 and cover 16 is received in a harness 18. The harness made of plastic or other suitable material is shown in FIG. 8. The harness is preferably injection molded in one piece but it may be made in two or more pieces, suitably connected to one another, e.g. by snap fasteners. The harness 18 includes a bottom strap 38 which is received in groove 32 in the bottom of the body so that the container strap 38 and bottom 30 lie in the same plane, providing a steady support for the article carrier when placed on a flat surface. Strap 38 gives added support to the cans in the pockets which it underlies. Extending upwardly from bottom strap 38 are end straps 60, 62 which fit snugly against the end walls of body 14. Preferably harness 18 includes some sort of means to permit it to be fastened to a carrying strap. One such means, shown in FIG. 8 are buttons 64, 66 which are molded integrally with straps 60, 62 and with a horizontal band 68 which is adapted to engage a shoulder 70 provided on the outer wall of body 14. Instead of buttons 64, 66 other detachable fasteners could be used to connect harness 18 to a carrying strap.

Another horizontal band 72 which is seated on a ledge 74 provided on the outer side walls 58 of cover 16 is connected to band 68 by means of a short vertical connecting strap 76 which is preferably molded integral with both horizontal band 72 and horizontal band 68. Connector strap 76 provides a flexible hinge permitting the cover 16 to be opened as shown in FIG. 2 without separating from the body 14 of the article carrier 10.

Instead of a harness 18 as described above, the container body 14 may be molded with ears or other extensions, (not shown) to provide an attachment for the strap by which the article carrier is supported, in which case means should be provided to connect cover 16 to body 14, so that the cover does not become separated when an article is being withdrawn by the user. Such means could be a hinge.

The article carrier 10 is completed by a strap 20, preferably of extruded polyethylene, the strap being provided with a series of punched holes 80 provided with slits 82. Holes 80 permit it to be adjustably connected to fasteners on body 14 or harness 18, e.g. fasteners 64, 66 according to the length desired and according to whether the strap is disposed over the shoulder or around the waist of the person wearing the article carrier.

The button fasteners 64, 66 at either end of the harness 18 also serve as a swivel for the adjustable shoulder or waist strap 20. A similar function would be served by other suitable fasteners. The short connector strap 76 serves as a hinge for the top and bottom of the container, thereby allowing one hand opening and closing, providing freedom of the other hand to handle fishing, hunting or other sporting or recreation equipment, etc. Other types of hinge affixed to or within the container may be used i place of strap 76 to insure that cover 16 does not separate from body 14 of the can holding receptacle.

It will be apparent that many modifications may be made in the article carrier described above without departing from the invention. For example a fastener could be added to insure that cover 16 remains closed if the friction fit between cover 16 and body 14 does not suffice and the container body could be provided with means to connect it directly to the carrying strap, without a harness. Further, as previously indicated, the harness could be made in several pieces, suitably connected, instead of being molded in a single piece. Further it is possible to mold the body and cover of more than a single resin. For example, a skin of polyvinylchloride, polycarbonate, polyolefin or polyester could be provided around a core of foamed polyurethane, polystyrene or acrylonitrile-butadiene-styrene polymer and glass reinforced foams could be used for additional strength. Pockets 22 could be proportioned to include additional space for a packet designed to heat or cool the container stored in the pocket, such packets being presently commercially available and usually functioning by a chemical or physical reaction which occurs when water is added to the packet or when a seal between two compartments in the packet is broken.

Having now described a preferred embodiment of the invention it is not intended that it be limited except as may be required by the appended claims.

We claim:

1. A portable article carrier comprising in combination:

a receptacle body having a substantially flat top and a substantially flat bottom and at least one curved sidewall, curved to conform to the person carrying said article carrier, said receptacle body consisting of thermally insulating material and containing a plurality of pockets each adapted to receive and store a can of beverage and to retain the heat or cold therein;

a receptacle cover for said receptacle body made of thermally insulating material and adapted to seat on said receptacle body;

a harness adapted to receive both said receptacle body and said receptacle cover whereby the body and cover are flexibly connected by said harness wherein said harness includes an upper horizontal strap portion surrounding the side walls of said cover, a lower horizontal strap portion surrounding the side walls of said receptacle body, a bottom strap portion disposed in a groove located in the bottom of said receptacle body and connected to said lower strap portion by at least two vertical strap portions disposed along the side walls of said receptacle body and connecting said bottom strap portion to said lower horizontal strap portion and a strap portion extending along the rear of said receptacle body and between said upper horizontal strap portion and said lower horizontal strap portion, permitting said harness to hingedly connect said receptacle body with said receptacle cover, all of said strap portions being integral with one another; and a carrying strap adapted to be worn by a person carrying said portable article carrier and including means adjustably connecting it to said harness.

2. The portable article carrier of claim 1 including in addition a swivel connection between said carrying strap and said harness.

3. The portable article carrier of claim 1 wherein the opposite side wall of said receptacle body is also curved outwardly to permit extraneous material encountered by the person wearing the article carrier to ward off extraneous objects.

4. The portable article carrier of claim 1 wherein the receptacle cover includes a depending rim and the receptacle body includes a stepped configuration into which said rim is received when the cover is seated on said body.

5. The portable article carrier of claim 1 including in addition, buttons on said harness for connecting said harness to said carrying strap.

6. The portable article carrier of claim 1 wherein the thermally insulating material comprises a foamed synthetic resin.

* * * * *